United States Patent [19]

Ishihara

[11] Patent Number: 4,930,335

[45] Date of Patent: Jun. 5, 1990

[54] LEVER-TYPE AUTO BODY DENT PULLER

[76] Inventor: Kosei Ishihara, c/o Kazuo Wachi, 755 E. 8th St., Chico, Calif. 95928

[21] Appl. No.: 375,351

[22] Filed: Jul. 3, 1989

[51] Int. Cl.[5] ..... B21D 1/12

[52] U.S. Cl. ..... 72/451; 72/705

[58] Field of Search ..... 72/389, 390, 391, 447, 72/451, 705; 83/363

[56] References Cited

U.S. PATENT DOCUMENTS

| | | | |
|---|---|---|---|
| 1,421,220 | 6/1922 | Hart | 81/363 |
| 2,191,720 | 2/1940 | Meinhardt | 72/705 |
| 2,696,240 | 12/1954 | Crowder . | |
| 2,749,795 | 6/1956 | Boykin, Jr. . | |
| 2,776,587 | 1/1957 | Killius | 72/705 |
| 2,949,144 | 8/1960 | Dredske et al. | 72/389 |
| 3,545,250 | 12/1970 | Jones . | |
| 3,548,627 | 12/1970 | Henshaw | 72/391 |
| 3,712,106 | 1/1973 | Holsapple et al. | 72/705 |
| 3,729,974 | 5/1973 | Tidwell . | |
| 4,089,201 | 5/1978 | Raptis . | |
| 4,116,035 | 9/1978 | Malarsky . | |
| 4,348,884 | 9/1982 | Wivinis . | |
| 4,503,701 | 3/1985 | Hardy . | |

*Primary Examiner*—Lowell A. Larson

[57] ABSTRACT

Two embodiments of fulcrum apparatus useful for easy and efficient dent pulling during automobile body repairing are provided in the invention. The apparatus works efficiently in most any position and comprises a first embodiment having dual levering arm and dual pivotal feet and a second embodiment having a single levering arm and a single foot. Both embodiments operate by pulling on a centrally aligned fixture affixed with a hook. The hook is designed for hooking attachment to a pull rod. The pull rod is passed through a series of aligned washers which are welded in the dent area of a damage auto body. When manual pull is applied to either the dual levers on the first embodiment or the single lever on the second embodiment, a controlled force is applied to the aligned washers realigning the dented area with the original surface of the damaged car body. Padded pivotal feet allows use of the apparatus in door areas and on other irregular car body surfaces.

5 Claims, 6 Drawing Sheets

LEVER-TYPE AUTO BODY DENT PULLER

BACKGROUND OF THE INVENTION

1. Field of the Invention

This invention relates to equipment used for pulling dents in the process of auto body repairing and refinishing. Normally, if the back side of the panel to be straightened is accessible, dents are pressed or punded out. In may cases, holes are drilled in the dent area, a hook rod is inserted, and the dents are jacked out or levered out. In most recent innovations, discs or washers are welded into the recess of the damaged areas with the apertures in straight alignment with one another. A metal rod is then passed through the apertures where it is pulled to straighten out the dented area. Providing pulling equipment which will adequately exert pull on the washers without pushing another dent in the car body surface where the puller feet rest, is the problem. Another problem is the uneven panel surfaces on which the puller feet must be rested. My invention, in two embodiments described hereinafter, is designed to solve both the foot placement problem, and the pull-push problem often encountered while using available equipment.

2. Description of the Prior Art

Many auto body dent pulling devices seen in past art patents are refined versions of screw and hydraulic jacks. As vehicular inside finishing became more sophisticated, equipment for auto body dent removal also shows interesting innovations. For example, the patent issued to Crowder, U.S. Pat. No. 2,696,240, dated Dec. 7, 1954, shows an interesting, if not necessarily practical, concept for using double magnets. The device is illustrative of the developing need for better dent pulling methods. External levering is seen in the Boykin, JR., device shown in U.S. Pat. No. 2,749,795, dated June 12, 1956. Boykin, Jr., takes into consideration the difficulty of removing inside upholstering to access the back side of a dented car panel. His device uses a screw hole in the dent. His device, however, has limited space between his puller and the position where the foot of the device must rest. Adjustable spaced footings and use of a pneumatic powered cylinder are seen in the Jones patent of Dec. 8, 1970, U.S. Pat. No. 3,545,250. Jones uses a chain to pull a bolted washer for dent removal and his patent illustrates the developing need for a non-damaging foot arrangement which is really not accomplished in his invention. Devices, both jacking and levering, are seen in other U.S. Patents including: U.S. Pat. Nos. 3,729,974; 4,089,201; 4,116,035; 4,348,884; and 4,503,701 U.S. Pat. No. 4,503,701 does show a leavering device with some adjustment provisions made for adjusting pressure foot distance relative to the pull mechanism. This device, however, is primarily directed towards a hook to be inserted through the dent area. The leavering method requires considerable strength and carefulness to accomplish a properly pulled dent.

The foregoing patents are mentioned here as illustrative of the need for an improved levering device for dent removal during auto body repair. My invention provides an improved device for auto body dent pulling.

SUMMARY OF THE INVENTION

In practicing my invention, I equip two embodiments with fulcrum devices useful for easy and efficient dent pulling during automobile body repairing. Although the devices work efficiently in most any plainer position, for descriptive purposes, they are described hereinafter oriented upright relative to the earth horizon. In a first embodiment, a flat elongated generally rectangular metal bar is affixed with two position adjustable U-shaped legs. The elongated metal bar, hereinafter referred to as the bridge bar, is illustratively horizontally positioned with a narrow first edge upwards, a narrow second edge downwards, and two wide flat surfaced opposite sides vertically disposed. The two U-shaped legs extend downwardly from the horizontal bridge bar. One U-shaped leg is slidably attached towards each end of the bridge bar. Each U end has a pivotal padded foot attached. The foot attachment is by universal hinging which allows all four feet individual multi-directional foot adjustment to compensate for uneven foot resting surfaces. An elongated cylinder formed as an inherent center section of the bridge bar has a bore longitudinally passing through centrally positioned. A portion of the elongated cylinder extends vertically upwards right angled relative to the horizontal bridge bar. The bore in the cylinder section provides a transverse passageway through the bridge bar. The bridge bar is right angled on opposite sides of the cylinder section producing two flat protruding shoulder-like plates of similar width to the bridge bar with a vertical edge aligned at right angles to the upper edge of the bridge bar, one on each longitudinal side of the extended portion of the cylinder. Mounted centrally on the bridge bar to pass slidably through the aperture in the cylinder section, is a vertically disposed rod. The rod by being threaded or by other mechanics is adjustably fitted to a cooperatively machined collar above the top of the cylinder. The rod is upwardly and downwardly adjustable and can be retained in the collar for levering. Levering is accomplished by two manually operated levers attached pivotally to the cylinder section shoulders and by linkage rods attached pivotally to the collar. Aligned washers are welded along a dented area in the vehicle body surface. A pull rod is passed along through the apertures in the washers. The lower distal end of the vertical rod is adapted for attachment of a small U-shaped fitting forming a hook. The hook can be hooked over the washer pull rod. The U-shaped hook is arranged to grasp the washer pull rod equidistance between the two outside washers. The rod can then be easily raised by manually moving the two levers to carefully pull out the dent. The levers are normally pulled up but, if preferred, changing the link position on the levers allows the levers to be pushed down.

The second embodiment consists of one elongated bar levering arm. The levering arm is adapted for slidable attachment of a one-piece leg. The leg is apertured adjacent the upper end in a size to fit and slide along the levering bar. A screw down tightener in the aperture area provides temporary retainment of the leg in a desired position on the levering bar. The leg has a pivotally attached padded foot. A braking spring strap at the pivotal foot attachment prevents the padded foot from moving too freely while the device is being manipulated during use attachment. A hook support member is affixed slidably to the levering arm and arranged to be adjusted for best positioning. Temporary retaining the support member in a fixed position is accomplished by a screw down tightener. A U-shaped washer pull rod hook is pivotally attached to the support member on the underside of the elongated levering arm bar. In use, the U-shaped hook can be positioned close to the padded foot, hooked over the washer pull rod, and by pull up leverage, the dent can be removed. Where necessary for best performance, the positions of the leg and the support member can be reversed and push down leverage can be used. The positioning of the hook supporting member to the leg for push or pull levering is dependent upon available foot resting space. In either case, the hook is fastened around the washer pull rod, force is applied to the lever arm manually, and the washers welded in the dent area are raised pulling out the dent.

Both embodiments of the instant invention apply a strong even force against the washer pull rod and the washers which helps to retract the dent evenly. Not only does my device make dent pulling easier for the user, but an entire elongated dent can be realigned with a body surface area in one motion. The need to manually pound out dents from a reverse side or by drilling holes in a dented area then pulling is eliminated. The pivotal foot action of the invention, especially the dual action foot pivoting of the first embodiment, allows for bracing against angled edges or other irregular car body surfaces.

Therefore, it is a primary object of my invention to provide a dent pulling fulcrum device which easily and envenly retracts washers welded to the dented area of an automobile body to straighten out the dented area.

Another object of my invention is to provide a dent pulling fulcrum device in a single levering form for uncomplicated dent pulling and in a double action levering form for more precision dent pulling during automobile body repair work.

A further object of the invention is to provide a dent pulling device with pivotal feet for use on uneven automobile body surfaces during body shop repair work.

Additional objects and the many advantages of the invention will come to light with a reading of the numbered parts described in the specification and a comparison of the described numbered parts with similarly numbered parts illustrated in the included drawings.

BRIEF DESCRIPTION OF THE DRAWINGS

Referring now to the drawings where.

DESCRIPTION OF THE PREFERRED EMBODIMENTS

Figure 1:
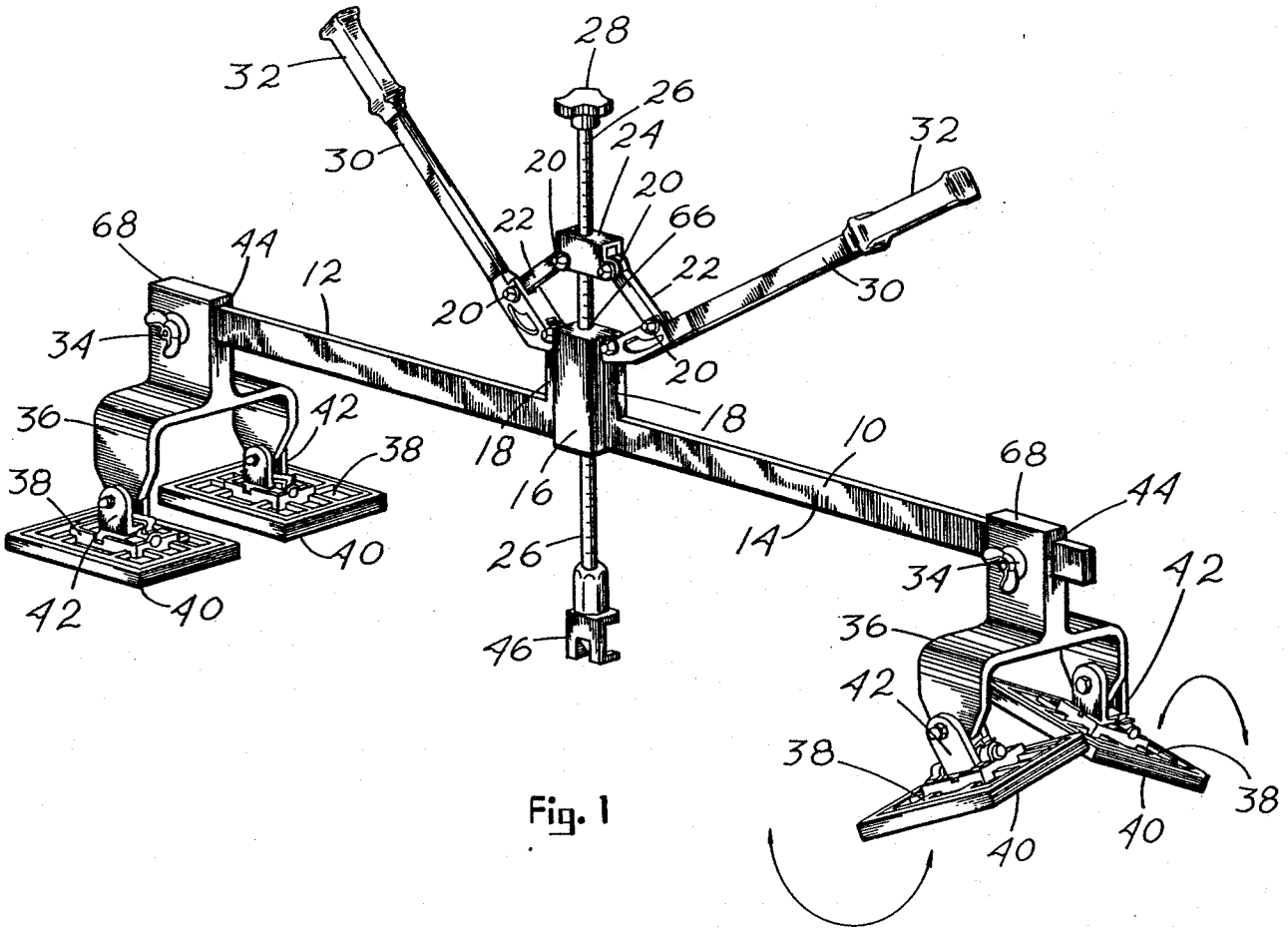
FIG. 1 shows a perspective view of a double levered automobile body dent puller according to a first embodiment of the invention. Four swiveling feet attached by U-shaped legs to the device are illustrated.
Figure 2:
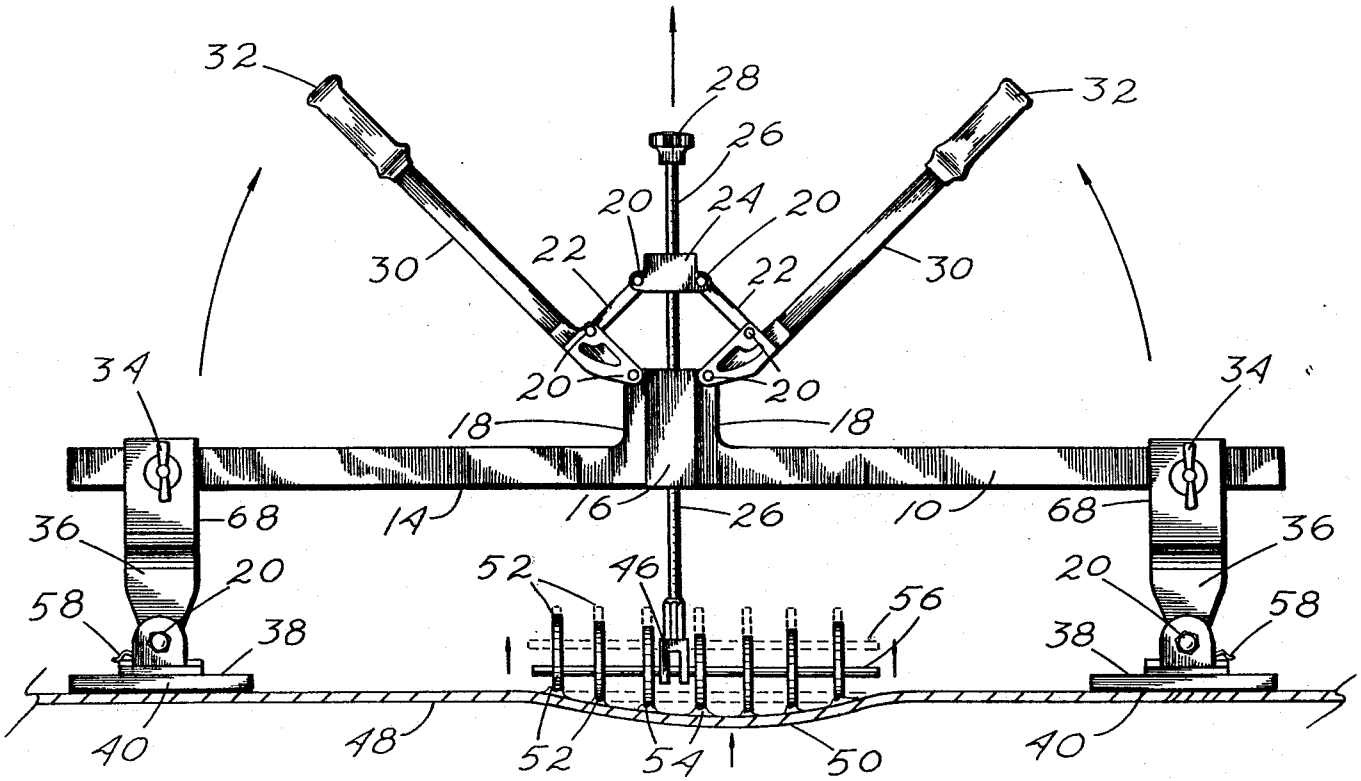
FIG. 2 is a side view of the FIG. 1 embodiment illustrating pulling up on the lever handles to raise a collar and a center rod attached to a pull rod affixed to aligned washers welded in the dent area of a panel of an automobile section. Single pin-hinged foot panels are shown on the U-shaped legs.

Referring now to the drawings at FIG. 1 and FIG. 2 where a first preferred embodiment according to the invention is illustrated. Although embodiments of the device including a first and a second embodiment detailed herein work efficiently in most any position, for descriptive purposes the devices are described concurrent with drawing positions and the earth horizon. In the FIG. 1 illustration, a horizontally aligned generally rectangular elongated bar designated bridge bar 10 is the principal support member. Bridge bar 10 has an upwardly faced bridge bar first edge 12 and a downwardly faced bridge bar second edge 14. Bridge bar 10 has two wide flat surfaced opposite sides vertically disposed. TWO U-shaped leg structure, U-shaped legs 36, are apertured through a support member, leg support member 68, on top with leg attachment apertures 44, which slidably fit the bar structure of bridge bar 10. U-shaped legs 36 can be temporarily locked into a desired position on bridge bar 10 by applying screw down tighteners 34. U-shaped legs 36 extend downwardly from horizontally positioned bridge bar 10 below bridge bar second edge 14. One U-shaped leg 36 is slidably attached towards each end of bridge bar 10. Each U end of U-shaped legs 36 has a pivotal foot attached designated foot panel 38. Foot panel 38 is affixed on the bottom or surface contact side with foot panel pad 40 to prevent surface scratching. Foot panels 38 in the FIG. 1 illustration are attached by universal hinging, designated universal swivel attachment 42, which allows all four of foot panels 38 individual multi-directional foot adjustment to compensate for uneven foot resting surfaces. A solid cylinder-like block, cylinder 16, is structured as an inherent part of bridge bar 10 and is centrally positioned in bridge bar 10. Cylinder 16 is longitudinally elongated. A portion of cylinder 16 extends upwardly right angled to bridge bar 10 above bridge bar first edge 12 a short distance. Bore 66 opened longitudinally through cylinder 16 provides a vertical passageway through bridge bar 10. Cylinder 16 has two protruding shoulder-like flat plates, lever attachment shoulders 18, running vertically along opposite sides. Lever attachment shoulders 18 are right angled continuations of bridge bar 10. Mounted centrally on bridge bar 10 to pass slidably through bore 66 in cylinder 16, is a vertically disposed pull rod, rod 26. Rod 26 has mechanics arranged to cooperatively operate with mechanics in a collar 24 through which rod 26 passes above the top of cylinder 16. The cooperative mechanics can be threading or any adjustable retainers which will maintain rod 26 adjustably retained temporarily fixed in collar 24. For length adjustment and for fastening pull rod hook 46 to washer pull rod 56 (FIG. 2), rod 26 is illustrated threaded. Rod 26, when threaded, can be raised and lowered by turning rod adjustment knob 28 which screws threaded rod 26 up and down in a threaded collar 24. Two lever arms 30, manually operated by grasping lever arm handles 32 and pulling up, are pivotally affixed by pivotal attachments 20 to lever attachment shoulders 18 and by lever link rods 22 attached by pivotal attachments 20 to a threaded collar 24 which pushes against and activates a threaded rod 26.

FIG. 2 shows how aligned washers 52 are welded, washer welds 54, along a dent area 50 in an automobile body surface section 48. Washer pull rod 56 is passed along through the apertures in washers 52. The lower distal end of the vertical rod 26 is provided with a small strong U-shaped hook, pull rod hook 46. Pull rod hook 46 is designed to hook around washer pull rod 56 equidistance between the two outside washers 52. Rod 26, shown threaded, can then be easily raised by upward force on lever arm handles 32 which raises collar 24, cooperatively threaded, when lever link rods 22 are forced up by the levering action of lever arms 30. Rod 26 slides freely through bore 66 and dent area 50 can be carefully pulled out. FIG. 2 also illustrates foot panels 38 affixed to U-shaped legs 36 by pivotal attachments 20 instead of by universal attachments 42. Foot panels 38, as illustrated in FIG. 2 and FIG. 3, are fitted with swivel brake strap 58 which somewhat restricts swiveling of foot panels 38 when moving the equipment or placing foot panels 38 on automobile body surface section 48 for use.

Figure 3:
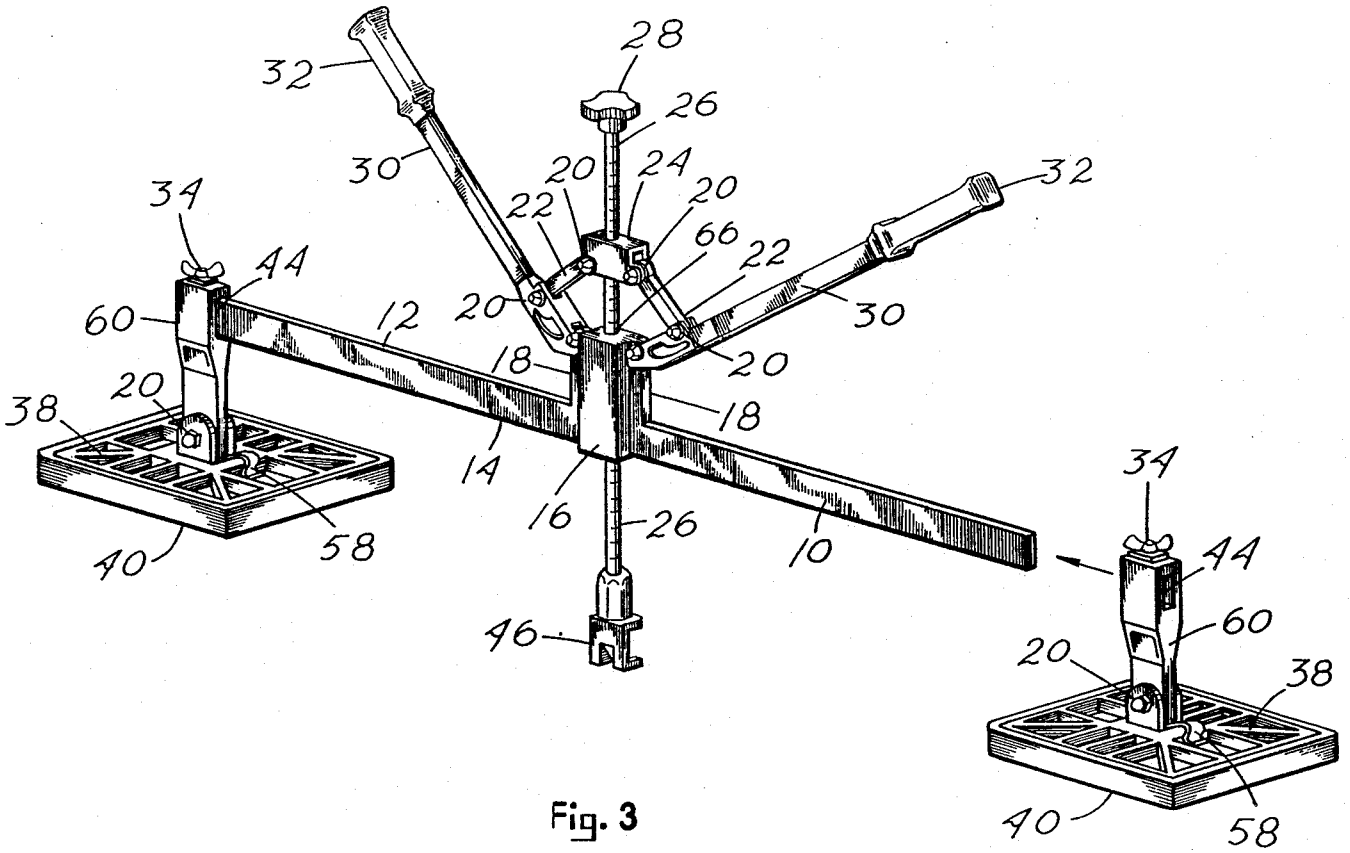
FIG. 3 shows a version of the first embodiment according to the invention illustrating single leg attachment to the support bar of the device.

In FIG. 3, a version of the first embodiment according to the invention is illiustrated with bridge bar 10 fitted with single piece legs 60. Leg attachment apertures 44 fit slidably over bridge bar 10 and can be temporally held in a fixed position by the application of screw down tighteners 34. Single piece legs 60 are hingedly attached by pivotal attachments 20 to single foot panels 38. All operational parts and functions are the same as previously described for the first preferred embodiment. Lever action is produced when handles 32 are pulled up.

Figure 4:
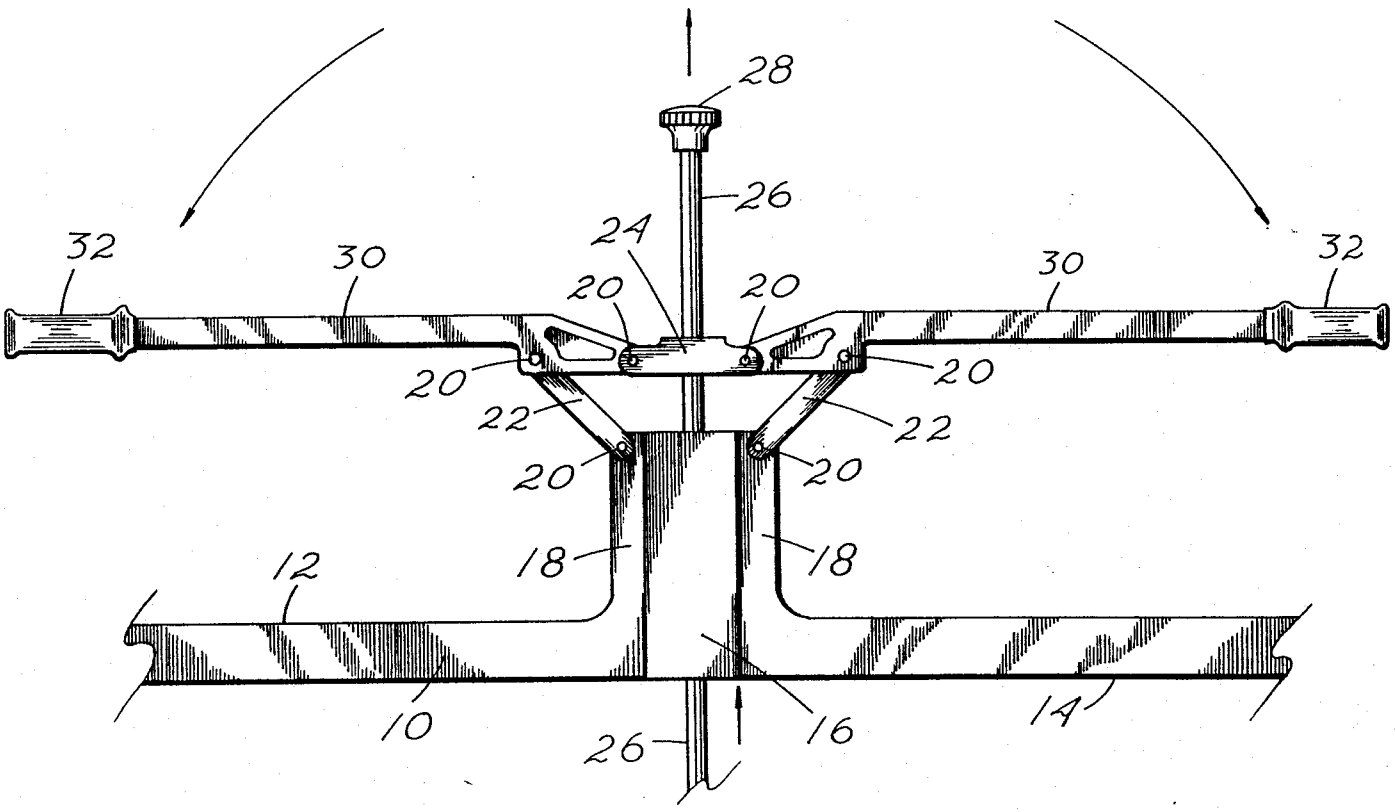
FIG. 4 is a partial view centrally of the double levering mechanics of the invention illustrating reverse positioning of the linkage which allows the central collar to be raised by pushing down on the lever handles rather than pulling up.

In the FIG. 4 illustration, a partial view centrally of the double levering mechanics of the invention is shown. This illustrates a reversed positioning of lever link rods 22 relative to attachment of lever arms 30. Lever link rods 22 are attached to lever attachment shoulders 18 and lever arms are attached to collar 24 instead of the lever attachment shoulders 18. Connected in this manner, the attachment ends of lever arms 30 become the linkage attached to collar 24 and lever link rods 22 provide the fulcrum leverage between lever attachment shoulders 18 and lever arms 30. When lever link rods 22 and lever arms 30 are changed to this position, the levering effect is reversed. To raise collar 24 in this assemblage, lever arm handless 32 must be pushed downward to lowerlever arms 30 and raise collar 24 upwards.

Figure 5:
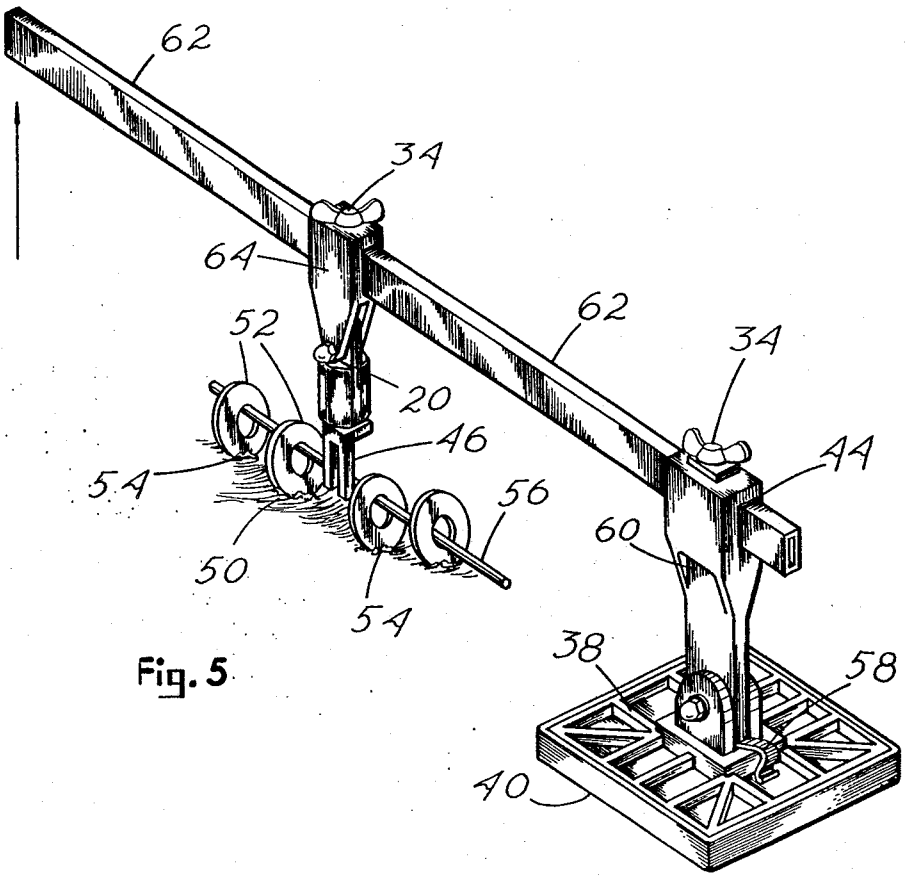
FIG. 5 shows a perspective view of a single arm lever bar embodiment of the invention with an adjustable hooking fixture attached centrally to the lever bar and a single leg and foot attached at one end. This positioning provides levering when the bar is pulled up for raising the hook and pulling up washers welded in a dent on an automobile body surface.
Figure 6:
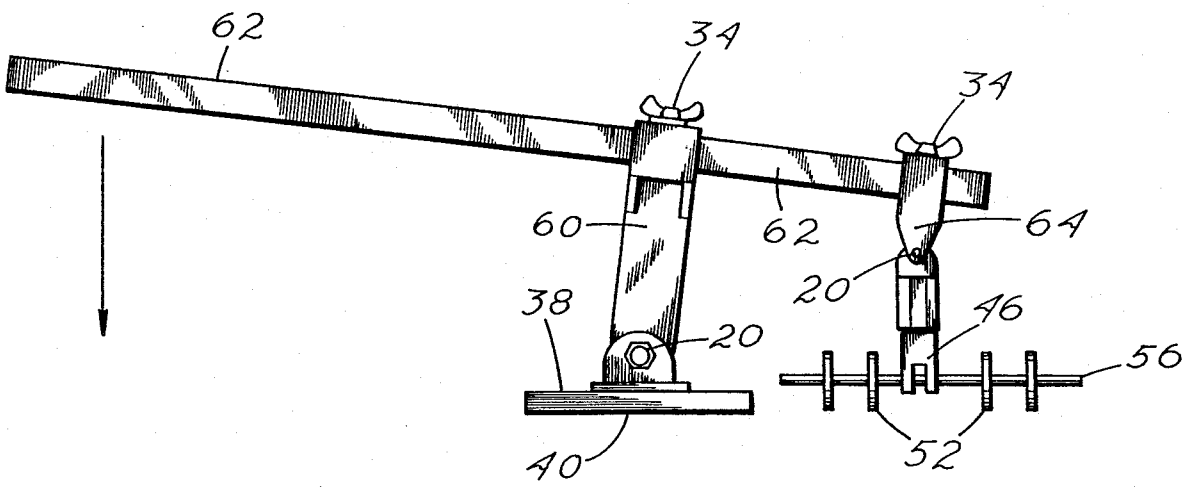
FIG. 6 shows the embodiment of FIG. 5 with the position on the lever bar of the support leg with one foot and the adjustable hooking fixture exchanged. In this position, levering is applied to the hook end by a downward push on the lever bar.

FIG. 5 illustrates a second embodiment of the instant invention in which a single elongated bar, levering arm 62, is used. Levering arm 62 is pivotally fitted endwardly to single-piece leg 60. Foot panel 38 with foot panel pad 40 is the same as is used in the FIG. 2 embodiment of the device. Hook support member 64 is affixed to levering arm 62 slidably utilizing leg attachment aperture 44. Hook support member 64 can be slidably positioned on levering arm 62 at a desired location and retained there temporarily by screw down tighteners 34. Pull rod hook 46, the same in all embodiments, is attached by pivotal attachment 20 to hook support member 64 extending below levering arm 62. In use, hook support member 64 is positioned as close as possible to single-piece leg 60 for best leverage. Pull rod hook 46 is then hooked as near center as possible to washer pull rod 56 run through apertures of washers 52 welded to dent area 50. The free end of levering arm 62 is then pulled upwards manually, raising washer pull rod 56 and washers 52 and straightening out dent area 50. Under conditions which might require it, single-piece leg 60 and hook support member 64 can be reversed as illustrated in FIG. 6. With single-piece leg 60 in a centered position on levering arm 62 and hook support member 64 towards one end, the levering action is reversed and lever arm 62 is pushed downward to pull hook support member 64 upwards.

Either of the described embodiments of the instant invention using either push or pull leverage apply a strong, controlled even force against washer pull rod 56 and washers 52 which helps to pull and smooth out dent area 50 evenly. Pivotal foot action provided in both embodiments, particularly the multiple movement provided by universal swivel attachment 42, allows the instant invention in both embodiments to be used effectively braced against uneven surfaces.

Although preferred embodiments of the invention have been described with considerable details in the foregoing specification and illustrated in the drawings, it is considered obvious that one skilled in the art could possibly make changes without effecting the efficiency of the device. Therefore, I reserve the right to make changes in the invention which do not exceed the intended scope of the appended claims and any changes made by others to similar devices which fall within the scope of my claims, I will consider to be my invention.

What is claimed is:

1. A levering apparatus for auto body dent pulling comprising:

a bridge bar, said bridge bar being an elongated bar horizontally disposed, said bridge bar slidably fitted adjacebt opposite terminal ends with downward disposed legs having pivotal feet thereon;

said bridge bar adapted upwards for pivotal attachment of two levering arms one adjacent each side of a centrally positioned bore passed vertically through said bridge bar;

a pull rod, said pull rod being a vertically disposed rod passed freely through said bore in said bridge bar retained adjustably by a collar, said collar positioned immediately above said bridge bar aligning said pull rod with said bore in said bridge bar;

linkage, said linkage pivotally affixing said levering arms to said collar providing fulcrum attachment moving said pull rod upwards and downwards through said bore in said bridge bar relative to reverse movement of free ends of said levering arms;

means for temporary retention of said slidably fitted downward disposed legs in a fixed position on said bridge bar;

means for adjusting upward and downward position of said pull rod in said collar;

means for attachment of hooking fixtures on a terminal end of said pulll rod below said bridge bar.

2. The levering apparatus of claim 1 wherein said downwardly disposed legs having pivotal feet thereon having said pivotal feet each affixed on a side opposite an attachment side with a pliable pad.

3. The levering apparatus of claim 1 wherein said two levering arms opposite said pivotal attachment thereof being free mobile arms with handles affixed to ends thereof.

4. The levering apparatus of claim 1 wherein said said legs slidably fitted adjacent terminal ends of said bridge bar having apertures in said legs, upper structure thereof, sized to allow said leg to slide freely along said bridge bar.

5. The levering apparatus of claim 1 wherein said means for temporary retention of said slidably fitted downwardly disposed legs in a fixed position on said bridge bar includes turnable fittings adapted for tightening and untightening in a manner to lock said legs in a temporary fixed position along said bridge bar and to release said legs.

* * * * *